US005250331A

United States Patent [19]

Grefalda

[11] Patent Number: 5,250,331

[45] Date of Patent: Oct. 5, 1993

[54] VERSATILE HOLIDAY DECORATION

[76] Inventor: Larry G. Grefalda, 5317 Perkins Rd., Oxnard, Calif. 93030

[21] Appl. No.: 804,000

[22] Filed: Dec. 9, 1991

[51] Int. Cl.[5] ..... A47G 33/08

[52] U.S. Cl. ..... 428/11; 362/121

[58] Field of Search ..... 428/7, 11; 362/121; D11/125

[56] References Cited

U.S. PATENT DOCUMENTS 3,272,976 9/1966 Charchan et al. ..... 428/11 X 4,214,023 7/1980 Day ..... 428/11

*Primary Examiner*—Henry F. Epstein

*Attorney, Agent, or Firm*—Brown, Martin, Haller & McClain

[57] ABSTRACT

The holiday ornament consists of a three-dimensional star constructed with a frame of narrow dowels interconnected with snap-on connectors. The frame can be readily disassembled for storage and re-assembled for use. A lightweight fabric skin is stretched over the frame and attached to the frame at the center of the star by a snap-on connector. The skin consists of separable panels to permit mixing of different panels as desired. Each panel corresponds to one leg of the star. A light or string of lights may be placed inside the frame.

6 Claims, 2 Drawing Sheets

VERSATILE HOLIDAY DECORATION

BACKGROUND OF THE INVENTION

It is a well-known custom to decorate homes or businesses during certain holidays, most commonly Christmas. Often, people go to considerable expense to purchase large decorations which are made of lightweight, molded plastic or similar material. Many of these decorations are designed so that lights can be used to illuminate the design. With lighted ornaments of this type, the light is seen through the translucent plastic so that the coloring of the plastic is picked up. The translucence provides a glow which is particularly suited to the holiday. After the holiday is over, these decorations are placed in storage, to be used the following year because their coloring, sentiment and/or configuration are applicable only to Christmas. Because of their relatively large size and delicate nature, the decorations require a great deal of storage room and are at risk of breakage by shifting around of other items stored nearby in garages, basements or attics.

For holidays other than Christmas it is often difficult to find decorations which are suitably colored and configured which are anything but paper. Also, since many of the holidays are not traditionally as elaborate and commercially driven as Christmas, the selection and number of sources of these decorations is relatively limited.

It would be desirable to provide a decoration which is easy to store in a small space with minimal risk of breakage and which can be used for any number of holidays simply by using different colored panels and wording, as appropriate, for different holidays. Such a decoration is provided by the present invention.

SUMMARY OF THE INVENTION

It is an advantage of the present invention to provide a holiday decoration which can be disassembled into its most basic components to facilitate storage.

It is another advantage of the present invention to provide a holiday decoration which has interchangeable panels to allow modification of the decoration for different holidays.

It is still another advantage of the present invention to provide a decoration which can include interchangeable attachments with holiday sentiments printed thereon.

In an exemplary embodiment, the versatile holiday ornament consists of a three-dimensional star constructed with a frame of narrow dowels or rods interconnected with snap-on connectors. The frame can be readily disassembled for storage and re-assembled for use. A lightweight fabric skin is stretched over the frame and attached to the frame at the center of the star by a snap-on connector. The connectors at the points of the star have slotted ends which may support a circular ring, a flat ring with holiday sentiments inscribed thereon, or tassels or tails, to name a few possible attachments. The skin consists of separable panels to permit mixing of different panels as desired. Each panel corresponds to one leg of the star. A light or string of lights may be placed inside the frame to illuminate the backside of the skin, causing the star to emit a glow with the color of the skin.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF THE PREFERRED EMBODIMENT

Figure 1:
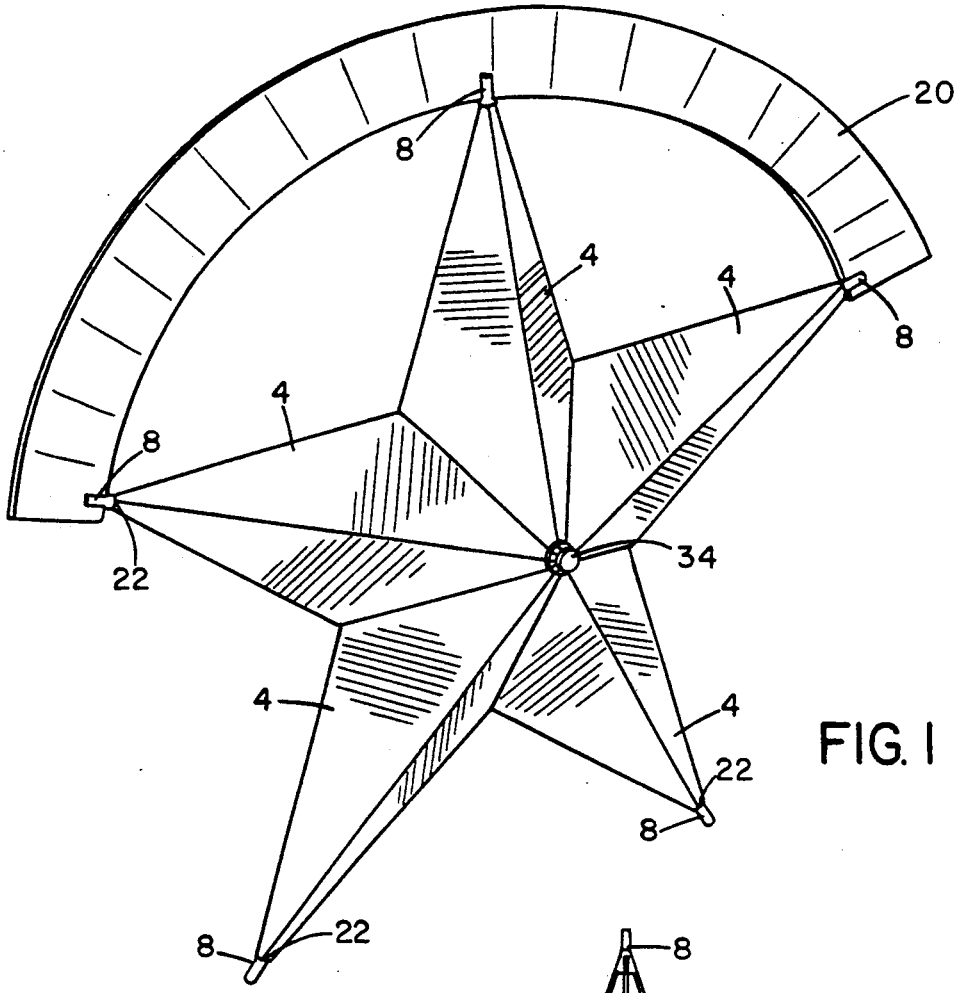
FIG. 1 is a perspective view of an assembled decoration.

The decoration illustrated in FIG. 1 is a five-pointed star which is thickest at its center where each of the panels 4 are joined by connector 34, tapering down to the end points 22 of each leg. Each panel 4 is designed to cover one leg of the star by sliding over the frame as it is pulled toward the center bass 5. End connectors 8 are disposed at the end of each leg of the star with the primary connecting portion being generally concealed by the panels 4. The outer end of each end connector 8 has a slot directed outward from the center into which may be inserted different accessories. In FIG. 1, a flat semicircle 20 is shown spanning three legs of the star. This semicircle 20 is shown as a flat partial ring onto which writing can be printed or embossed to express holiday greetings. Other accessories may be substituted such as a hoop (rounded cross-section) or straight strips. Also, tassels or lightweight lanterns may also be attached to the end connectors 8.

Figure 2:
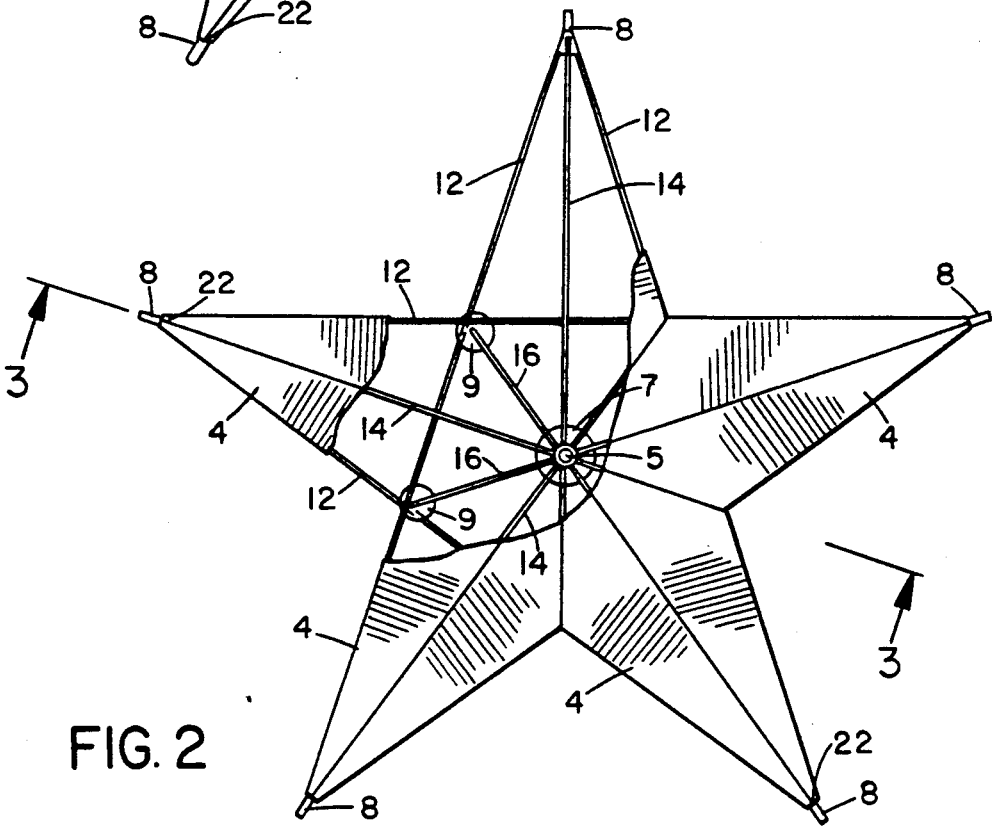
FIG. 2 is a side view of the frame of the decoration.
Figure 3:
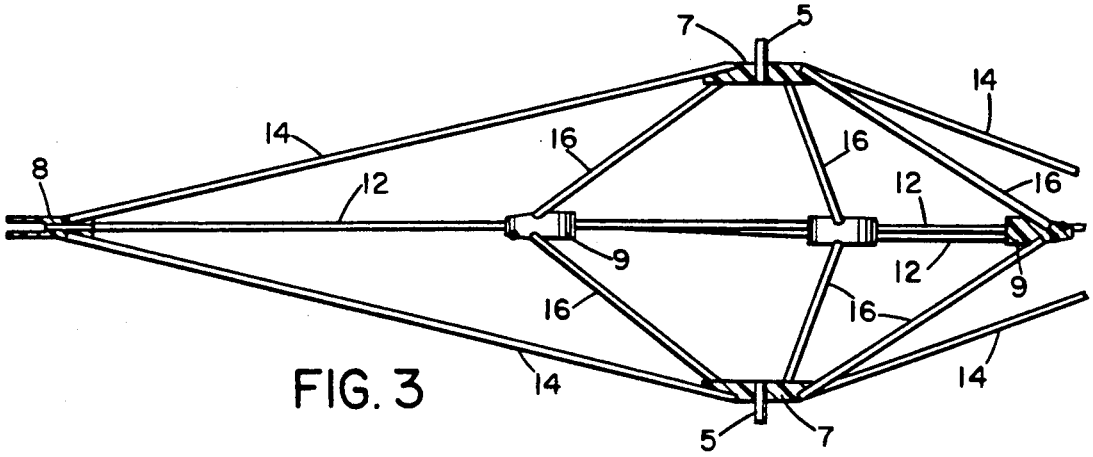
FIG. 3 is a front view of an assembled decoration with the skin partially cut away to show the frame.

As illustrated in FIGS. 2 and 3, the frame is made up of lightweight dowels of varied lengths. For the purpose of this disclosure, a dowel is a slender cylindrical rod. The term "dowel" refers to the commercial name for wooden rods, but these rods may be made of other lightweight materials which would be suitable for the purposes of the invention. The five-pointed star is assembled using three different lengths of dowels. The long dowel 12 extends from the end 22 of one leg to the end 22 of a leg on the opposite side of the star. Five long dowels are used. A medium-length dowel 14 extends radially from the center 2 to each end 22. Since the center is raised with respect to a plane connecting the five ends 22, medium dowels 14 are needed on 10 each side of the star to provide its symmetrical, three-dimensional quality. Therefore, ten medium dowels are required, with five per side. The medium dowels 14 extend not only radially from the center connector 7 but inwardly toward the ends 22 as well. Short dowels 16 extend from the connector 7 to the intersection point 18 of two legs. As with the medium dowels, ten short dowels 16 are required to provide symmetry around a plane connecting the five ends which bisects the star at its center which can be seen in FIG. 3. (The plane is parallel to the line created by dowels 12.)

Figure 4A:
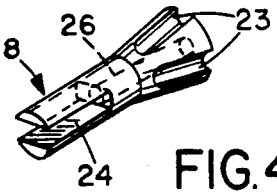
FIG. 4*a* shows the end connector, 4*b* shows the inside connector and 4*c* shows the center connector.

The dowels 12, 14 and 16 are connected by groups of snap-in connectors. End connector 8, illustrated in FIG. 4*a*, attaches two long dowels 12 together with two medium dowels 14. Thus, end connector 8 has four slots 23 into which the dowels may be inserted. As described previously, end connector 8 also has a slot or notch 24 in its outer end to permit insertion of decorative accessories. Also, at least one of the end connectors 8 may have a bore 26 through its length to permit insertion of a wire for providing electrical power to a light or string of lights contained within the star.

Figure 4B:
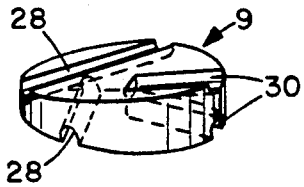
FIG. 4 provides perspective views of three snap-on connectors used for assembling the frame, where
Figure 4C:
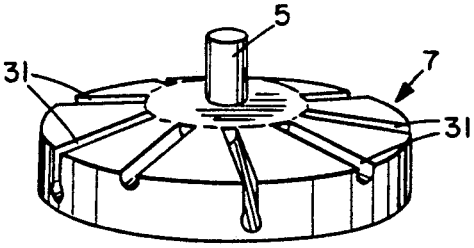
Figure 5:
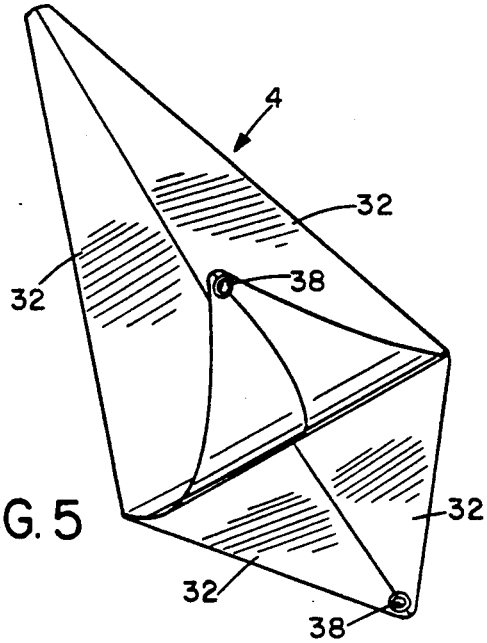
FIG. 5 is a front view of a panel for use on the decoration.

Center connector 7, illustrated in FIG. 4*c*, joins together the dowels terminating at the center of the star, each dowel being inserted in a slot 31. Medium dowels 14 and short dowels 16 radiate from the center so that ten dowels are connected by center connector 7. Also in the center of connector 7 is a boss 5 with which the panels 4 are held in place.

Inside connector 9, shown in FIG. 4*b*, joins together the dowels passing through or running to an intersection point. Connector 9 is generally flat and may be disc-like, square, or any appropriate shape with two grooves 28 running across the diameter into which long dowels 12 can be inserted at a point in the middle of the long dowel. Two grooves 30 are then provided on opposite sides of the disc at a slight angle to the plane of the disc into which the ends of two short dowels 16 will be inserted.

After assembly of the frame, panels 4 are introduced. Each panel 4 is a sleeve-like structure consisting of four sections 32, each of which is an oblique triangle (two sections 32 on the front, two on the back). Openings 38 in the panels 4 are aligned with boss 5 on center connector 7 and connector 34 is snapped on to hold the panels firmly in place. Each section 32 can be the same color and pattern as the other sections in a panel 4, or they can alternate colors. Each panel 4 can be the same color and/or pattern as the other panels 4, or they can alternate or be random. For example, for Christmas, red and green alternating sections 32 can be used, or the entire skin made up of all panels can be white. For the fourth of July, red-and-white striped panels might be used, or some combination of red, white and blue would be appropriate. For other holidays, e.g., Cinco de Mayo, red, white and green combinations might be used with tassels or lanterns hanging from the lower four points. Brightly-colored panels might be combined with a flat ring or partial ring running around the star for birthday party decor or for other occasions.

The materials from which the decoration is constructed include wood, fiberglass, lightweight metal or any similar material for the dowels or rods of the frame. In the exemplary embodiment, ¼ wood dowels were used. The skin can be made from any durable fabric desired including polyester, nylon or silk, and could also include Mylar® and cellophane. The individual sections can be sewn, melted, taped or glued together to form the panels. In the exemplary embodiment the panels are translucent fabric, but an interesting effect can be achieved using transparent materials or opaque materials with pinholes punched therein to permit small amounts of light to escape, creating a twinkling effect. The connectors are preferably formed from a resilient rubber-like material which can include polyethylene, polypropylene and Teflon®, among others.

For use with internal lighting, a short string of commonly-used low-power Christmas lights may be attached to the frame before attaching the panels 4.

After use, the star can be disassembled in reverse order by first removing connectors 34 and sliding the panels 4 off of the frame. The dowels 12, 14 and 16 are then removed from the connectors 7, 8 and 9 so that a compact package of dowels, connectors and panels can be stored until the decoration's next use.

The decoration need not be limited to a five-pointed star, but could also have four, six or any other number of points that a star might have.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A holiday ornament comprising:

a star-shaped frame having two sides and a plurality of legs, each leg having a point, said frame comprising:

a plurality of dowels;

a plurality of connectors for releasably retaining selected dowels of said plurality of dowels to other dowels of said plurality;

a plurality of panels, each panel configured to fit over one said leg and attach to a connection means on said frame, each said panel being interchangeable with other panels of said plurality; and a center connector for each side of said frame for attachment to said connection means to hold said plurality of panels onto said frame.

2. A holiday ornament as in claim 1 wherein said plurality of connectors includes end connectors, each end connector having a slot into which decorative accessories can be inserted to be supported by said holiday ornament.

3. A holiday ornament as in claim 1 wherein at least a portion of said panels comprises a translucent fabric.

4. A holiday ornament as in claim 1 wherein at least a portion of said panels comprises an opaque material with pinholes punched therein.

5. A holiday ornament as in claim 1 further comprising means for inserting at least one light source within said frame.

6. An ornamental device comprising:

a star-shaped frame having two sides and a plurality of legs, each leg having a point, said frame comprising:

a plurality of rigid rods including short rods, medium rods and long rods;

a plurality of inner connectors for releasably attaching selected short rods and long rods of said plurality of rigid rods to other short rods and long rods;

a plurality of point connectors for releasably attaching ends of selected medium rods and long rods and having means for retaining additional decorations external to said star-shaped frame; and a plurality of panels, each panel configured to fit over one said leg and attach to at least one inner connector, each said panel being interchangeable with other panels of said plurality.

* * * * *